US008935008B2

(12) United States Patent
Storm et al.

(10) Patent No.: US 8,935,008 B2
(45) Date of Patent: Jan. 13, 2015

(54) SYSTEM AND METHOD FOR HEATING VENTILATION AND AIR CONDITIONING COMPONENT DETECTION

(75) Inventors: Timothy Wayne Storm, Tyler, TX (US); Daniel J. Mitchell, Gilmer, TX (US)

(73) Assignee: Trane International Inc., Piscataway, NJ (US)

( * ) Notice: Subject to any disclaimer, the term of this patent is extended or adjusted under 35 U.S.C. 154(b) by 609 days.

(21) Appl. No.: 13/285,722

(22) Filed: Oct. 31, 2011

(65) Prior Publication Data

US 2013/0030574 A1 Jan. 31, 2013

Related U.S. Application Data

(60) Provisional application No. 61/513,371, filed on Jul. 29, 2011.

(51) Int. Cl.
*G01M 1/38* (2006.01)
*F24F 11/00* (2006.01)

(52) U.S. Cl.
CPC ..... *F24F 11/006* (2013.01); *F24F 2011/0063* (2013.01); *F24F 2011/0068* (2013.01)
USPC ..... 700/276

(58) Field of Classification Search
CPC ..... F24F 11/0086; F24F 11/006
USPC ..... 700/276, 292
See application file for complete search history.

(56) References Cited

U.S. PATENT DOCUMENTS

| | | | | |
|---|---|---|---|---|
| 4,557,114 | A | 12/1985 | Kato et al. | |
| 4,574,226 | A | 3/1986 | Binder | |
| 5,909,348 | A | 6/1999 | Zydek et al. | |
| 6,441,565 | B1 | 8/2002 | Levy | |
| 7,174,728 | B2 | 2/2007 | Jayanth | |
| 2005/0116055 | A1* | 6/2005 | Alles | 236/49.1 |
| 2008/0029610 | A1* | 2/2008 | Nichols | 236/1 C |
| 2008/0176503 | A1* | 7/2008 | Stanimirovic | 454/229 |
| 2012/0112728 | A1* | 5/2012 | Bodo et al. | 323/311 |
| 2012/0221150 | A1* | 8/2012 | Arensmeier | 700/276 |

FOREIGN PATENT DOCUMENTS

WO 2004068614 A2 8/2004

OTHER PUBLICATIONS

Canadian Office Action; Application No. 2,780,639 dated Oct. 29, 2013; 3 pages.

* cited by examiner

*Primary Examiner* — Sean Shechtman
*Assistant Examiner* — Chad Rapp
(74) *Attorney, Agent, or Firm* — Conley Rose, P.C.; J. Robert Brown, Jr.; Michael J. Schofield

(57) ABSTRACT

A method for detecting heating, ventilation, and air conditioning (HVAC) components is provided. The method includes the steps of measuring an initial current at a current sensor in a circuit, while a relay is de-energized; energizing the relay; measuring, at a periodic interval, an energized current while the relay is energized; incrementing a counter if an absolute difference between a first voltage related to the energized current and a second voltage related to the initial current is above a threshold; and determining a HVAC component is present if the counter exceeds a pre-determined value during a pre-determined time period.

20 Claims, 4 Drawing Sheets

SYSTEM AND METHOD FOR HEATING VENTILATION AND AIR CONDITIONING COMPONENT DETECTION

CROSS-REFERENCE TO RELATED APPLICATIONS

The present application claims priority to U.S. Provisional Patent Application No. 61/513,371, filed on Jul. 29, 2011 by Timothy Wayne Storm, et al., entitled "System and Method for Heating Ventilation and Air Conditioning Component Detection" which is incorporated by reference herein as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The term "HVAC system" will be used herein to refer to any system capable of heating, cooling, and/or ventilating an indoor space. The heating, cooling, and/or ventilation parameters of an HVAC system can typically be adjusted by a thermostat, which might also be referred to as an indoor comfort control. The thermostat is typically connected to an HVAC system controller that controls the HVAC system based on input received from the thermostat. At least a portion of the functions carried out by the thermostat might be performed by a programmable microprocessor or a similar component. The microprocessor might be connected to a temperature sensor that can sense the temperature of the space in which the thermostat is located and send a suitable signal to the microprocessor indicating the temperature in that space. The microprocessor might receive power from the HVAC system controller and might connect to a suitable battery power source as a backup. The thermostat may be operated to change the temperature set point, cause the system to operate in a heating mode or a cooling mode, operate only a fan of the HVAC system, and/or perform other functions. In some cases, the term "HVAC system" might refer to the thermostat and the HVAC system controller in combination with the air heating and cooling components, and in other cases, the term "HVAC system" might refer to the air heating and cooling components independently of the thermostat and the HVAC system controller.

SUMMARY OF THE DISCLOSURE

In some embodiments of the disclosure, a method for detecting heating, ventilation, and air conditioning (HVAC) components is provided. The method comprises the steps of measuring an initial current at a current sensor in a circuit, while a relay is de-energized; energizing the relay; measuring, at a periodic interval, an energized current while the relay is energized; incrementing a counter if an absolute difference between a first voltage related to the energized current and a second voltage related to the initial current is above a threshold; and determining a HVAC component is present if the counter exceeds a pre-determined value during a pre-determined time period.

In other embodiments of the disclosure, a heating, ventilation, and air conditioning (HVAC) system is provided. The HAVC system comprises a current sensor configured to measure an initial current in a circuit, and measure an energized current subsequent to a relay being energized; and a controller configured to receive a first voltage related to the initial current, after receiving the first voltage, receive a second voltage related to the energized current, calculate an absolute difference between the first voltage and the second voltage, increment a counter if the absolute difference is above a threshold, and determine presence of an HVAC component if the counter exceeds a pre-determined value during a pre-determined time period.

In still other embodiments of the disclosure a heating, ventilation, and air conditioning (HVAC) controller is provided. The HVAC controller comprising a relay; a current sense circuit; and a processor configured to receive a first voltage related to an initial current; energize the relay; periodically thereafter receive a second voltage related to an energized current; calculate an absolute difference between the first voltage and the second voltage; increment a counter if the absolute difference is above a threshold; and determine presence of an HVAC component if the counter exceeds a pre-determined value during a pre-determined time period.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Some HVAC controllers may be configured to control dampers, zone sensors, or heat pumps. Embodiments of the present disclosure provide an HVAC controller that may be further configured to detect whether or not a load is connected, thus determining the presence of an HVAC component, for example, a damper, zone sensor, or heat pump. In certain embodiments, if a heat pump is connected, the controller may be further configured to detect the number of stages in the heat pump.

Figure 1:
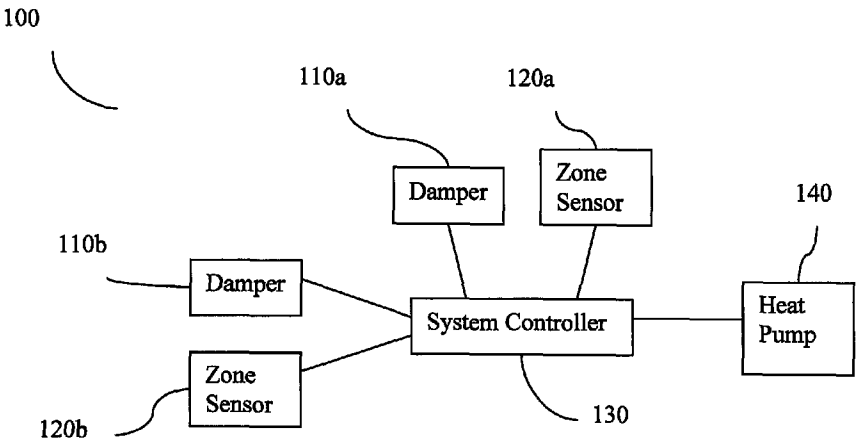
FIG. 1 is a simplified schematic diagram of an HVAC system according to an embodiment of the disclosure.

FIG. 1 is a simplified schematic diagram of an HVAC system 100 according to an embodiment of the disclosure. The HVAC system 100 comprises dampers 110*a*, 110*b*, zone sensors 120*a*, 120*b*, a heat pump 140, and a system controller 130. Each damper 110*a*, 110*b* is paired with a zone sensor 120*a*, 120*b*. Data from the zone sensor 120*a*, 120*b* may be used by the system controller 130 to make decisions regarding the operation of the dampers 110*a*, 110*b*. While only two dampers 110*a*, 110*b* and two zone sensors 120*a*, 120*b* may be pictured, any number of dampers and zone sensors may be operated by the system controller. The system controller 130 might be any combination of hardware, firmware, software, and/or other elements, such as, but not limited to, one or more microprocessors, memory components, and network communication or telecommunication elements.

The HVAC system 100 may also comprise the following components not pictured herein: a compressor, refrigerant, a heat exchanger, and/or other components that are well known to those of skill in the art as being capable of heating and/or cooling air. The HVAC system 100 might have various configurations such as a split system or a package system, a ducted system or a non-ducted system, a heat pump or a traditional heating/cooling system, or other configurations known to those of skill in the art. While only a single HVAC system 100 is shown, the HVAC system 100 might consist of multiple units that are capable of operating independently.

The HVAC system 100 might also comprise a ventilator, a prefilter, an air cleaner, a humidifier, and/or other components capable of circulating and/or further conditioning heated or cooled air. The ventilator may introduce conditioned air into an interior space, introduce outdoor air into the interior space, and/or exhaust interior air to the outdoors. The prefilter may comprise a filter medium that can capture relatively large particulate matter prior to air exiting the prefilter and entering the air cleaner. The humidifier may be operated to adjust the relative humidity of the circulating air.

The HVAC system 100 can provide heating, cooling, and/or ventilation to a structure, such as a residence, an office, or some other type of building. The HVAC system 100 may be outside the structure, it should be understood that at least some portions of the HVAC system 100 might be located inside the structure. The structure might comprise a plurality of zones, each of which might be a single room or a plurality of rooms. The HVAC system 100 might be configured to circulate and/or condition the air of each of the zones independently of one another.

The dampers 110*a*, 110*b* may be operated by the system controller 130 to control air flow to various zones. The system controller 130 may send a signal to dampers 110*a*, 110*b* to cause them to open. The system controller 130 may also send a signal to dampers 110*a*, 110*b* to cause them to close. The system controller 130 may cause the dampers 110*a*, 110*b* to open or close based open data received from a zone sensor 120*a*, 120*b* in a zone that receives conditioned air via the dampers 110*a*, 110*b*. The data may include zone temperature, zone humidity, and/or other environmental data. For example, zone sensor 120*a* may detect that the temperature in a zone in which it is installed has dropped below or risen above a desired temperature. The zone sensor 120*a* would transmit data indicating the temperature to the system controller 130. The system controller 130 may then cause the damper 110*a* in the zone to open, thereby introducing heated or cooled air into the zone.

In some HVAC systems it may be desirable to detect whether or not a damper is installed. For example, a technician configuring the HVAC system may not be aware of how many zones have been installed. The system controller 130 may be configured to detect the presence of certain HVAC components, for example, dampers or zone sensors. The system controller 130 may also be configured to detect whether a heat pump is connected to the system and how many stages the heat pump comprises.

Figure 2:
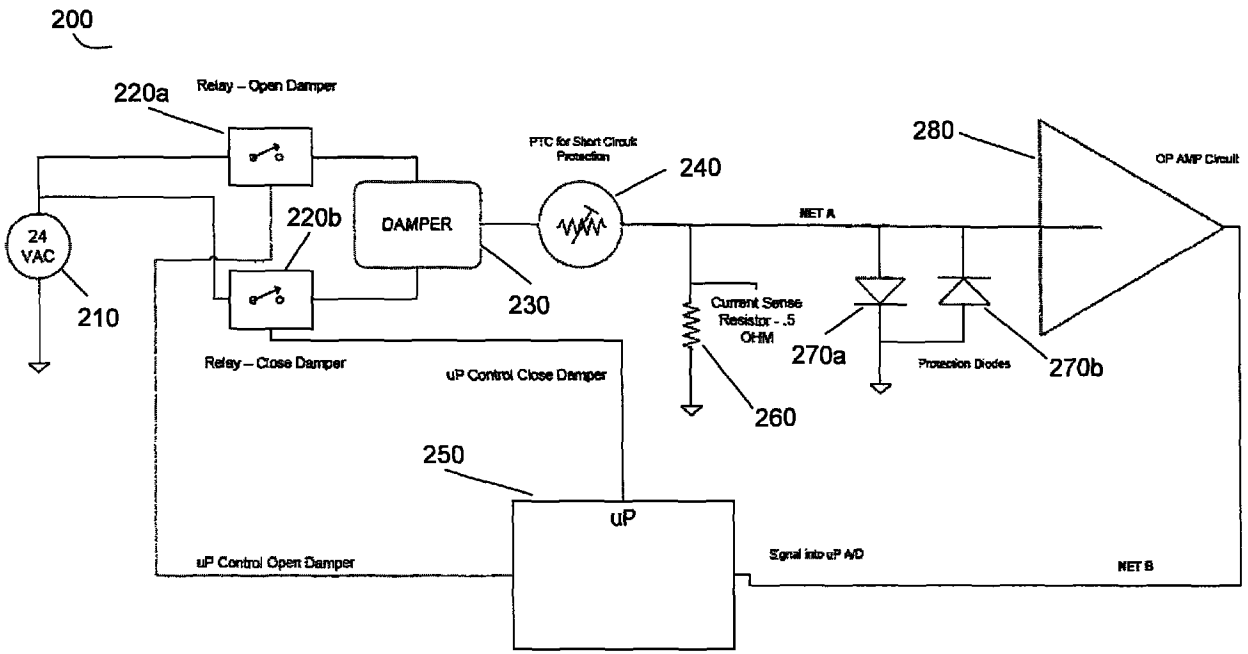
FIG. 2 is a schematic diagram of HVAC component detection circuit according to an embodiment of the disclosure.

FIG. 2 is a schematic diagram of HVAC component detection circuit 200 according to an embodiment of the disclosure. The HVAC component detection circuit 200 comprises a power source 210, relays 220*a*, 220*b*, a damper 230, a resettable fuse 240, a processor 250, a current sense resistor 260, diodes 270*a*, 270*b*, and an operational amplifier (op-amp) 280. The power source 210 may provide 24 volt alternating current (VAC) to the relays 220*a*, 220*b*. Relay 220*a* may be connected to damper 230 to enable opening of the damper 230 when relay 220*a* is energized. Relay 220*b* may be connected to damper 230 to enable closing of the damper 230 when relay 220*b* is energized. Relay 220*a* and relay 220*b* may be controlled by the processor 250. The processor 250 may energize relay 220*a* to cause damper 230 to open. The processor 250 may energize relay 220*b* to cause damper 230 to close.

In certain cases it may be useful to detect whether or not a damper 230 has been installed. If a damper 230 has been installed, a signal may be output from the damper 230 when the relays 220*a*, 220*b* are energized. The signal comprises a voltage and current which is sensed across the current sense resistor 260. The op-amp 280 receives the signal and conditions the signal for input to the processor 250. The processor 250 may then determine whether or not a damper 230 has been installed.

The processor 250 may determine the presence of damper 230 by measuring an initial voltage output by the op-amp 280. The initial voltage is measured before relay 220*a*, 220*b* is energized. After relay 220*a*, 220*b* is energized, processor 250 may measure the energized voltage output by op-amp 280. The processor 250 may take repeated measurements during a pre-determined time period. The measurements may be taken at specified intervals. After each measurement, the processor 250 computes an absolute difference between the energized voltage and the initial voltage. If the value of the absolute difference is above a threshold, the processor 250 increments a counter. After the pre-determined time period expires, the processor 250 may evaluate the value of the counter. If the counter value is greater than a pre-determined threshold, then the processor 250 determines than a damper 230 is connected. If the counter value is less than the pre-determined threshold, then the processor 250 determines that a damper 230 is not connected. It should be noted that while the example above describes a process for detecting the presence of a damper, the process may be modified or other processes used as apparent to one skilled in the art to determine whether other HVAC components are present.

If no damper has been installed, the 24 VAC may be applied directly to the HVAC component detection circuit 200. A resettable fuse 240 may trip preventing damage to the processor 250 in the case where 24 VAC is applied directly to the circuit. The resettable fuse 240 may be a positive temperature coefficient (PTC) thermistor or other equivalent component. Diodes 270*a*, 270*b* may provide overvoltage protection to the current sense resistor in the case where 24VAC is applied directly to the circuit. The diodes 270*a*, 270*b* draw enough current in a short period of time to cause the resettable fuse 240 to trip.

Figure 3:
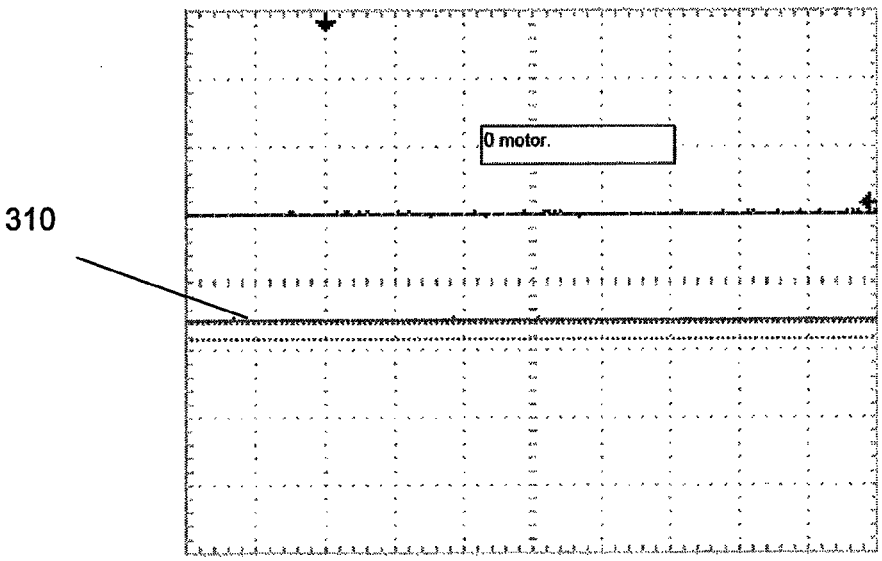
FIG. 3 is an illustration of a measurement taken by an HVAC component detection circuit with no HVAC component present according to an embodiment of the disclosure.

FIG. 3 is an illustration of a measurement taken by an HVAC component detection circuit with no HVAC component present according to an embodiment of the disclosure. Waveform 310 is a representation of the voltage output from the op-amp 280 to the processor 250. The vertical axis represents voltage, and the horizontal axis represents time. The voltage remains constant as time increases, thus the absolute difference between an initial voltage and a subsequent voltage would always be zero. As such, any threshold greater than zero would result in the processor 250 not incrementing the counter. If the counter does not exceed a threshold, the processor 250 determines that no HVAC component is present.

Figure 4:
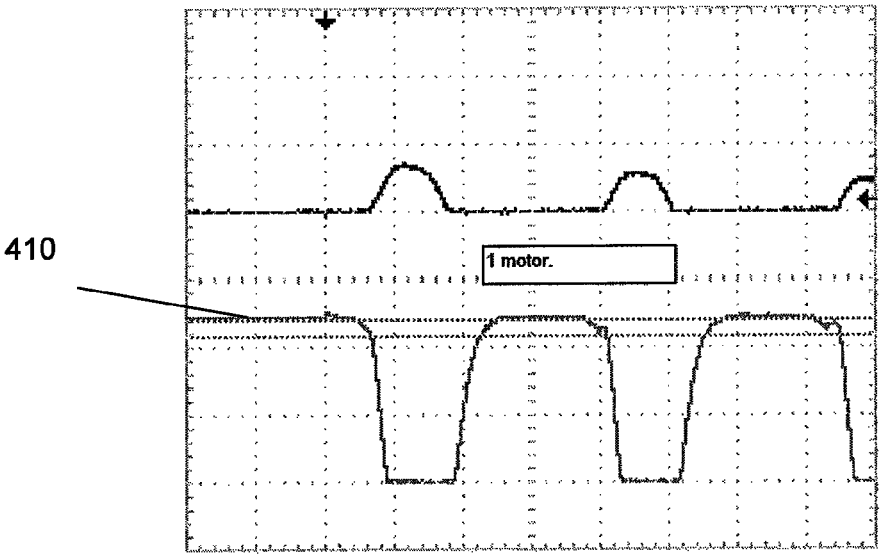
FIG. 4 is an illustration of a measurement taken by an HVAC component detection circuit according with a HVAC component present to an embodiment of the disclosure.

FIG. 4 is an illustration of a measurement taken by an HVAC component detection circuit according with a HVAC component present to an embodiment of the disclosure. Waveform 410 is a representation of the voltage output from the op-amp 280 to the processor 250. The vertical axis represents voltage, and the horizontal axis represents time. The voltage varies with time, as such the absolute difference between an initial voltage and a subsequent energized voltage would be greater than zero. If the absolute difference is greater than a threshold, then a counter is incremented. If the counter value exceeds a threshold in a predetermined time period, then the processor 250 determines that an HVAC component is present.

Figure 5:
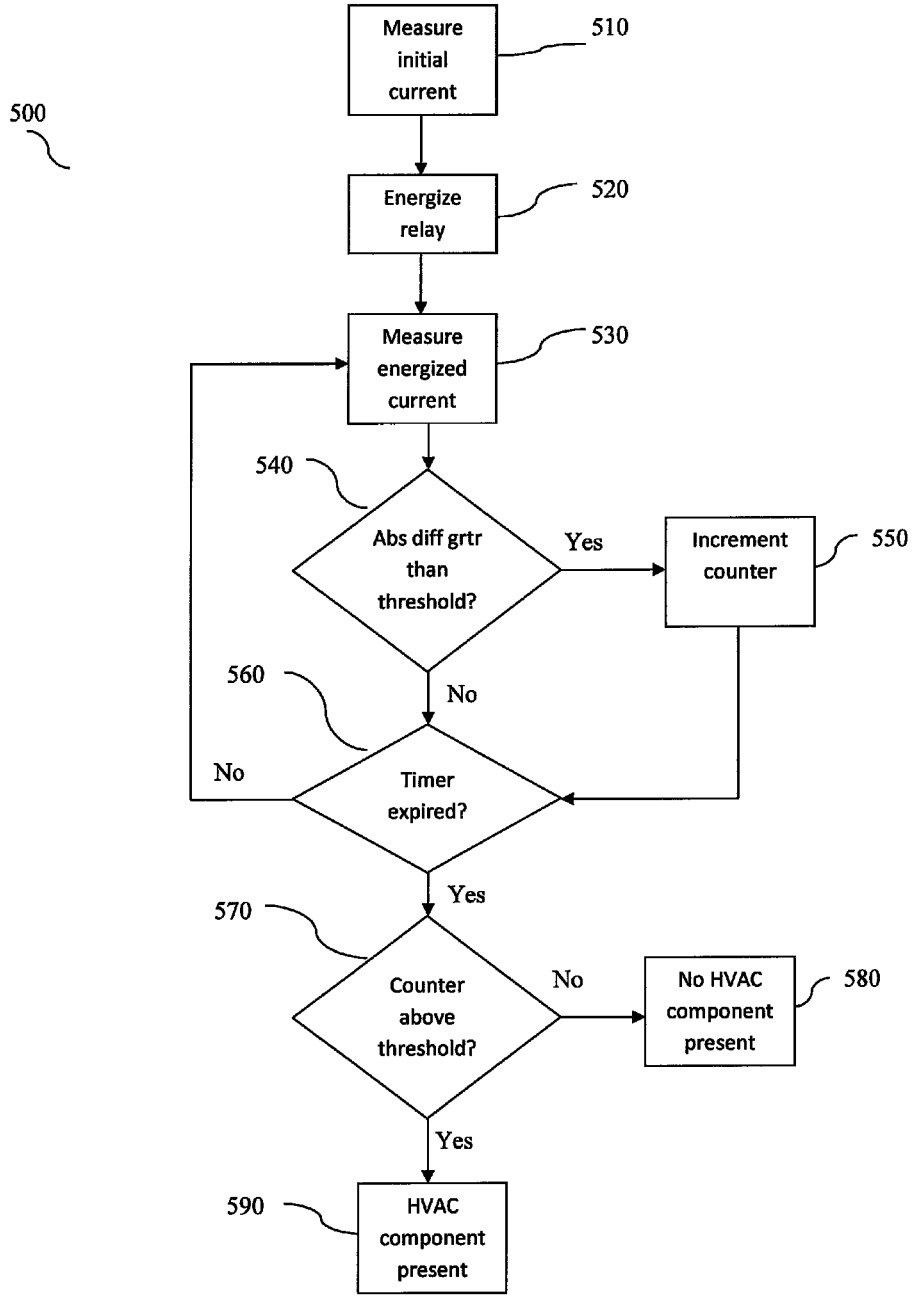
FIG. 5 is flowchart for a method for detecting an HVAC component according to an embodiment of the disclosure.

FIG. 5 is a flow chart of an embodiment of a method for detecting an HVAC component 500. The method begins at step 510 by measuring an initial current in a circuit while a relay in the circuit is not energized. The initial current may be measured across a current sense resistor or using other means for current detection. The initial current may be converted to a voltage value by an op-amp and transmitted to a processor or other system component capable of measuring the voltage output from the op-amp. After the initial current is measured, the relay may be energized at step 520. The relay may be part of a system controller in an HVAC system. The relay may be used to control power provided to an HVAC component, for example a damper, zone sensor, or heat pump. After the relay has been energized, an energized current is measured at step 530. The energized current may be measured in the same fashion as the initial current and at the same location in the circuit. The energized current may also be converted to a voltage by the op-amp for measurement by the processor or other system component. At step 540, the processor may calculate an absolute difference between the voltage related to the initial current and the voltage related to the energized current. If the absolute difference is greater than a pre-determined threshold, then a counter is incremented at step 550. If the absolute difference is less than the pre-determined threshold, or if the counter has been incremented, the processor may then check to see if a pre-determined time period has elapsed at step 560. The processor may accomplish step 560 by starting a timer at the time the initial current is measured and then checking to see if the timer has expired. If the timer has not expired, the method returns to step 530 and measures the energized current again. If the timer has expired, the processor then checks the value of the counter and compares it to a pre-determined threshold at step 570. If the counter is above the threshold, then the processor determines that an HVAC component is present at step 590. If the counter is below the threshold, then the processor determines that no HVAC component is present.

In a certain embodiment, the method 500 would begin at time 't'. The processor would initialize a counter with a value of zero. The processor would also record an initial voltage calculated based on an initial current sensed at the current sense resistor. After the initial voltage has been stored, the processor would energize a relay to either open or close a damper. The processor would then store an energized voltage based on an energized current sensed at the current sense resistor. The processor would store an energized voltage every one millisecond (ms). After each energized voltage is stored, the processor would calculate an absolute difference between the initial voltage and the energized voltage. If the difference is greater than 0.3667 volts, the counter is incremented. The process of storing the energized voltage, calculating the absolute difference, and incrementing the counter (if necessary), would be repeated for 250 ms. At the end of 250 ms (250 cycles), the value in the counter is evaluated. If the value of the counter is greater than or equal to 30, then a damper is assumed to be present. If the value of the counter is less than 30, then a damper is assumed to not be present. While the certain embodiment described above describes certain values, other values may be used as appropriate in the method 500.

In an embodiment, the system controller 130 may comprise an interactive touch screen display that not only displays information but can accept user inputs. That is, various portions of the system controller 130 can act as virtual buttons that, when contacted, cause data to be entered into the system controller 130. For example, the virtual buttons on the system controller 130 might be used to adjust a temperature set point, switch between heating and cooling modes, switch between home and away modes, change the zone that a set point applies to, or perform other functions.

In an embodiment, the system controller 130 might also include a virtual menu button that provides access to a plurality of additional functions. For example, when the virtual menu button is pressed by a user or technician, a menu interface might appear. The menu interface might appear on an interactive touch screen that includes a plurality of virtual buttons. When one of the virtual buttons on the menu interface is contacted, another interface related to the selected virtual button might appear. For example, when a zone configuration button is pressed, a zone configuration related interface might be displayed. The system controller 130 may then execute the method described above to determine if there are zones with dampers connected to be configured. The method may also be used to determine that a damper has been connected, but no zone sensor has been associated with the damper. For example, the system controller may detect a damper but not receive a signal from a zone sensor, or the system controller 130 may receive a signal from a zone sensor, but not detect a damper. The same method may be applied to any HVAC component that requires additional HVAC components be installed for proper functionality.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

Additional embodiments and description of the present disclosure are provided in Appendix A which is attached hereto and incorporated herein by reference for all purposes. Pages 1-21 of Appendix A represent various waveforms as measured in certain configurations of HVAC systems. Pages 22-25 of Appendix A represent an embodiment of a HVAC component detection circuit. Pages 26A-26T represent a portion of an embodiment of an HVAC system.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Also, techniques, systems, subsystems and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method for detecting heating, ventilation, and air conditioning (HVAC) components comprising:

measuring an initial current at a current sensor in a circuit while a relay is de-energized;

energizing the relay;

measuring, at a periodic interval, an energized current while the relay is energized;

incrementing a counter if an absolute difference between a first voltage related to the energized current and a second voltage related to the initial current is above a threshold;

determining an HVAC component is present if the counter exceeds a pre-determined value during a pre-determined time period; and determining no HVAC component is present if the counter does not exceed a pre-determined threshold during the pre-determined time period.

2. The method of claim 1, wherein the HVAC component is one of a zone damper, a zone sensor, a heat pump, an air conditioner, and a driver circuit.

3. The method of claim 2, further comprising:

detecting a number of stages of the HVAC component.

4. The method of claim 1, further comprising:

indicating the presence of the HVAC component; and configuring an HVAC system based upon the indication.

5. The method of claim 4, further comprising:

indicating the absence of a second required HVAC component as a result of determining the presence of the HVAC component.

6. The method of claim 5, wherein the second required HVAC component is a zone sensor and the HVAC component is a zone damper.

7. A heating, ventilation, and air conditioning (HVAC) system comprising:

a current sensor configured to measure an initial current in a circuit and measure an energized current subsequent to a relay being energized; and a controller configured to:

receive a first voltage related to the initial current;

after receiving the first voltage, receive a second voltage related to the energized current;

calculate an absolute difference between the first voltage and the second voltage;

increment a counter if the absolute difference is above a threshold;

determine the presence of an HVAC component if the counter exceeds a pre-determined value during a pre-determined time period; and determine no HVAC component is present if the counter does not exceed a pre-determined threshold during the pre-determined time period.

8. The system of claim 7, wherein the value of the energized current is received at a time interval, and wherein the pre-determined time period is equal to 250 intervals.

9. The system of claim 8, wherein the interval is 1 ms.

10. The system of claim 8, wherein the pre-determined value is 30.

11. The system of claim 7, wherein the threshold is 0.3667 volts.

12. A heating, ventilation, and air conditioning (HVAC) controller comprising:

a relay;

a current sense circuit; and a processor configured to:

receive a first voltage related to an initial current;

energize the relay;

periodically thereafter receive a second voltage related to an energized current;

calculate an absolute difference between the first voltage and the second voltage;

increment a counter if the absolute difference is above a threshold;

determine presence of an HVAC component if the counter exceeds a pre-determined value during a pre-determined time period; and determine no HVAC component is present if the counter does not exceed a pre-determined threshold during the pre-determined time period.

13. The HVAC controller of claim 12, wherein the current sense circuit measures the initial current and the energized current at a current sense resistor and an op-amp outputs the first voltage and the second voltage.

14. The HVAC controller of claim 13, wherein the current sense circuit comprises the current sense resistor, the op-amp, a resettable fuse, and a plurality of protection diodes.

15. The HVAC controller of claim 14, wherein the resettable fuse is configured to trip in a fault condition, and wherein the fault condition comprises applying an excess voltage to the current sense circuit.

16. The HVAC controller of claim 12, further comprising a user interface.

17. The HVAC controller of claim 16, wherein the controller is further configured to provide an indication via the user interface related to the presence of the HVAC component.

18. The HVAC controller of claim 17, wherein the indication indicates that the HVAC component is present, but not configured.

19. The HVAC controller of claim 17, wherein the indication indicates that the HVAC component is present, but a required HVAC component is not present.

20. The HVAC controller of claim 17, wherein the indication indicates that the HVAC component is not present.

* * * * *